US007647785B2

(12) United States Patent
Fujiyoshi et al.

(10) Patent No.: US 7,647,785 B2
(45) Date of Patent: Jan. 19, 2010

(54) AIR CONDITIONING SYSTEM

(75) Inventors: Ryuusuke Fujiyoshi, Sakai (JP); Osamu Tanaka, Sakai (JP); Masakazu Hirai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 558 days.

(21) Appl. No.: 10/536,444

(22) PCT Filed: Apr. 6, 2004

(86) PCT No.: PCT/JP2004/004973

§ 371 (c)(1),
(2), (4) Date: May 25, 2005

(87) PCT Pub. No.: WO2004/092659

PCT Pub. Date: Oct. 28, 2004

(65) Prior Publication Data

US 2006/0059928 A1 Mar. 23, 2006

(30) Foreign Application Priority Data

Apr. 11, 2003 (JP) ..... 2003-107466
May 9, 2003 (JP) ..... 2003-131054

(51) Int. Cl.
*F25B 49/00* (2006.01)
*F24F 11/00* (2006.01)

(52) U.S. Cl. ..... 62/176.6; 236/44 C

(58) Field of Classification Search ..... 236/44 C; 62/176.6, 199; 165/205, 208
See application file for complete search history.

(56) References Cited

U.S. PATENT DOCUMENTS 5,277,034 A * 1/1994 Hojo et al. ..... 62/160
5,317,907 A * 6/1994 Shimizu et al. ..... 62/176.6
5,823,006 A * 10/1998 Jung ..... 62/291
2006/0254294 A1 11/2006 Shimamoto et al.

FOREIGN PATENT DOCUMENTS

| | | | |
|---|---|---|---|
| GB | 2 255 171 A | | 4/1991 |
| JP | 01-296063 A | | 11/1989 |
| JP | 03-260539 A | | 11/1991 |
| JP | 06-129692 A | | 5/1994 |
| JP | 08178362 A | * | 7/1996 |
| JP | 10-197028 A | | 7/1998 |
| JP | 2000-018766 A | | 1/2000 |
| JP | 2002-054832 A | | 2/2002 |
| JP | 2002-323251 A | | 11/2002 |

* cited by examiner

*Primary Examiner*—Chen-Wen Jiang
(74) *Attorney, Agent, or Firm*—Global IP Counselors

(57) ABSTRACT

The present invention provides an air conditioning system that can appropriately adjust humidity. The air conditioning system is an air conditioning system that comprises a plurality of indoor units that jointly air conditions a same space, comprising a first indoor unit and a second indoor unit. The first indoor unit comprises a first indoor heat exchanger that adjusts the temperature in the space. The second indoor unit comprises a second indoor heat exchanger and a humidifying element. The second indoor heat exchanger adjusts the temperature in the space. The humidifying element adjusts the humidity in the space. Further, the air conditioning system, during humidity adjustment, adjusts the humidity in the space by the humidifying element with greater priority than adjusting the temperature in the space by the second indoor heat exchanger.

34 Claims, 4 Drawing Sheets

AIR CONDITIONING SYSTEM

CROSS-REFERENCE TO RELATED APPLICATIONS

This nonprovisional application claims priority under 35 U.S.C. §119(a) to Japanese Patent Application No. 2003-107466, filed in Japan on Apr. 11, 2003, and Japanese Patent Application No. 2003-131054, filed in Japan on May 9, 2003, the entire contents of which are hereby incorporated by reference.

FIELD OF THE INVENTION

The present invention relates to an air conditioning system comprising a plurality of indoor units.

BACKGROUND ART

It is common to use an air conditioning system comprising a plurality of indoor units that jointly air conditions the same space. There are air conditioning systems that adjust both the temperature and the humidity in a room. In such air conditioning systems, it is common that each indoor unit has both a temperature adjustment function and a humidity adjustment function, and each indoor unit simultaneously adjusts the temperature and the humidity in a room (refer to Japanese Published Patent Application No. H6-129692). For example, there are air conditioning systems wherein each indoor unit comprises a heat exchanger, an indoor fan, and a humidifier. The heat exchanger adjusts the temperature of the air sent to the room by exchanging heat with the air that passes therethrough. The indoor fan generates an airflow that passes through the heat exchanger and is sent to the room. The humidifier humidifies the air sent to the room. In this type of air conditioning system, the indoor fan generates the airflow, and the temperature of this airflow is adjusted by the indoor heat exchanger and is also humidified by the humidifier.

However, in an air conditioning system as described above, the situation arises wherein each indoor unit frequently operates principally to adjust the temperature, and the humidity is not appropriately adjusted. To raise an example of the above, although each indoor unit performs temperature adjustment as well as humidity adjustment, each indoor unit sometimes transitions to a thermo-off state to perform temperature adjustment. In the thermo-off state, the indoor fan is stopped, and humidified air is consequently no longer sent to the room. Consequently, the humidity in the room becomes insufficiently adjusted.

SUMMARY OF THE INVENTION

It is an object of the present invention to provide an air conditioning system that can appropriately adjust humidity.

The air conditioning system according to a first aspect is an air conditioning system that comprises a plurality of indoor units that jointly air conditions a same space, comprising a first indoor unit and a second indoor unit. The first indoor unit comprises a first temperature adjusting unit that adjusts the temperature in the space. The second indoor unit comprises a second temperature adjusting unit and a humidity adjusting unit. The second temperature adjusting unit adjusts the temperature in the space. The humidity adjusting unit adjusts the humidity in the space. Further, the second indoor unit, during humidity adjustment, adjusts the humidity in the space by the humidity adjusting unit with greater priority than adjusting the temperature in the space by the second temperature adjusting unit.

With this air conditioning system, adjustment of the humidity in the space by the humidity adjusting unit is given priority over adjustment of the temperature in the space by the second temperature adjusting unit during humidity adjustment. Consequently, the adjustment of the temperature in the space does not frequently interfere with the adjustment of the humidity. Consequently, the humidity can be appropriately adjusted with this air conditioning system.

The air conditioning system according to a second aspect is an air conditioning system that comprises a plurality of indoor units that jointly air conditions a same space, comprising a first indoor unit and a second indoor unit. The first indoor unit comprises a first temperature adjusting unit that adjusts the temperature in the space. The second indoor unit comprises a second temperature adjusting unit and a humidity adjusting unit. The second temperature adjusting unit adjusts the temperature in the space. The humidity adjusting unit adjusts the humidity in the space. Further, the second indoor unit adjusts the humidity in the space by the humidity adjusting unit in accordance with the operation state of the first indoor unit.

With this air conditioning system, the second indoor unit adjusts the humidity in the space by the humidity adjusting unit in accordance with the operation state of the first indoor unit. For example, if the humidity in the space needs to be adjusted due to the operation state of the first indoor unit, then the humidity in the space can be adjusted by the second indoor unit. Thereby, the humidity can be appropriately adjusted with this air conditioning system.

The air conditioning system according to a third aspect is an air conditioning system that comprises a plurality of indoor units that jointly air conditions a same space, comprising a first indoor unit and a second indoor unit. The first indoor unit comprises a first temperature adjusting unit that adjusts the temperature in the space. The second indoor unit comprises a second temperature adjusting unit and a humidity adjusting unit. The second temperature adjusting unit adjusts the temperature in the space. The humidity adjusting unit adjusts the humidity in the space. Further, if the first indoor unit is performing a prescribed operation, the second indoor unit adjusts the humidity in the space by the humidity adjusting unit with greater priority than adjusting the temperature in the space by the second temperature adjusting unit.

With this air conditioning system, if the first indoor unit is performing a prescribed operation, then the adjustment of the humidity by the second indoor unit is given priority over the adjustment of the temperature. Consequently, in the second indoor unit, the adjustment of the temperature in the space does not frequently interfere with the adjustment of the humidity. Thereby, the humidity can be adjusted more appropriately with this air conditioning system.

The air conditioning system according to a fourth aspect is the air conditioning system as recited in any one of the first through third aspects, wherein the first indoor unit controls output based on the temperature in the space. In addition, during humidity adjustment, the second indoor unit controls output based on the humidity in the space. Furthermore, the control of the output recited here includes not only the control of the output of the current, voltage, and the like, but also the control of the constituent parts that constitute the air conditioner, such as the fan, the flap, the motor operated valve, and the like.

With this air conditioning system, the second indoor unit controls the output in accordance with the humidity during humidity adjustment, in contrast to the first indoor unit controlling the output in accordance with the temperature. Consequently, the temperature is appropriately adjusted by the first indoor unit, and the humidity is appropriately adjusted by the second indoor unit. Thereby, the temperature and the humidity can be appropriately adjusted with this air conditioning system.

The air conditioning system according to a fifth aspect is the air conditioning system as recited in the fourth aspect, wherein the first indoor unit comprises a first indoor fan and a first control unit. The first indoor fan sends temperature-adjusted air to the space. The first control unit controls the first indoor fan based on the temperature in the space. In addition, the second indoor unit comprises a second indoor fan and a second control unit. The second indoor fan sends humidity-adjusted air to the space. The second control unit controls the second indoor fan based on the humidity in the space during humidity adjustment.

With this air conditioning system, the first control unit of the first indoor unit controls the first indoor fan based on the temperature in the space. In addition, the second control unit controls the second indoor fan based on the humidity in the space. Consequently, the temperature in the room can be made appropriate by the first indoor unit, and the humidity in the room can also be made appropriate by the second indoor unit.

The air conditioning system according to a sixth aspect is the air conditioning system as recited in the fifth aspect, wherein the second indoor unit further comprises a humidity sensor that detects the humidity in the space. Further, the second control unit controls the second indoor fan based on the humidity detected by the humidity sensor.

With this air conditioning system, the second indoor unit comprises the humidity sensor, and the second indoor fan is controlled based on the humidity detected by the humidity sensor. Consequently, with this air conditioning system, the humidity in the room can be accurately detected, and the humidity in the room can be adjusted.

The air conditioning system according to a seventh aspect is the air conditioning system as recited in the fifth or sixth aspects, wherein the second indoor fan sends temperature-adjusted air to the space during temperature adjustment and not during humidity adjustment, and sends humidity-adjusted air to the space during humidity adjustment.

With this air conditioning system, the second indoor fan of the second indoor unit sends into the space temperature-adjusted air during temperature adjustment and not during humidity adjustment, and sends into the space humidity-adjusted air during humidity adjustment. For example, the same second indoor fan serves double duty for both the case wherein the cooling operation is performed without performing humidity adjustment, and the case wherein humidity adjustment is performed. Consequently, with this air conditioning system, the system can be constituted at a low cost.

The air conditioning system according to an eighth aspect is the air conditioning system as recited in any one of the first through seventh aspects, wherein the first temperature adjusting unit of the first indoor unit has a heating function. The humidity adjusting unit of the second indoor unit has a humidifying function. The second temperature adjusting unit of the second indoor unit has a heating function. Further, during humidification, the second indoor unit humidifies the space with greater priority than heating the space.

When the room is being heated, the air tends dry out, and it is consequently important to ensure a prescribed amount of humidification to maintain the comfort of the occupants, and the like.

With this air conditioning system, the humidification of the room is given priority over heating of the room during humidification. Consequently, in this air conditioning system, the amount of humidification can be sufficiently ensured even if heating is being performed.

The air conditioning system according to a ninth aspect is the air conditioning system as recited in the eighth aspect, wherein the first temperature adjusting unit of the first indoor unit further has a cooling function. In addition, the second temperature adjusting unit of the second indoor unit further has a cooling function.

With this air conditioning system, during cooling, the first indoor unit and the second indoor unit can both perform cooling. Consequently, the system can be constituted with little waste and at a low cost.

The air conditioning system according to a tenth aspect is the air conditioning system as recited in the eighth or ninth aspects, further comprising a detecting means. The detecting means detects whether the first indoor unit is performing the heating operation. Further, if the first indoor unit is performing the heating operation, then the second indoor unit performs the humidifying operation by the humidity adjusting unit. Furthermore, it is acceptable for the detecting means to be located outside or inside the second indoor unit.

With this air conditioning system, the detecting means detects whether the first indoor unit is performing the heating operation. Furthermore, if the first indoor unit is performing the heating operation, then the second indoor unit performs the humidifying operation. Thereby, with this air conditioning system, the humidity in the space can be appropriately adjusted during the heating operation, which tends to dry out the air in the space.

The air conditioning system according to an eleventh aspect is the air conditioning system as recited in the ninth aspect, further comprising a detecting means. The detecting means detects whether the first indoor unit is performing the heating operation or the cooling operation. Further, the second indoor unit performs the humidifying operation by the humidity adjusting unit if the first indoor unit is performing the heating operation, and performs the cooling operation by the second temperature adjusting unit if the first indoor unit is performing the cooling operation. Furthermore, it is acceptable for the detecting means to be located outside or inside the second indoor unit.

With this air conditioning system, the detecting means detects whether the first indoor unit is performing the heating operation or the cooling operation. Furthermore, if the first indoor unit is performing the heating operation, then the second indoor unit performs the humidifying operation by the humidity adjusting unit. Thereby, the humidity in the space can be appropriately adjusted during the heating operation, which tends to dry out the air in the space. In addition, if the first indoor unit is performing the cooling operation, then the second indoor unit performs the cooling operation by the second temperature adjusting unit. Thereby, during the cooling operation, which has a low need for humidification, the second indoor unit performs the cooling operation together with the first indoor unit. With this air conditioning system as discussed above, if the first indoor unit is performing the heating operation or if performing the cooling operation, then the second indoor unit can be made to function efficiently in both cases.

The air conditioning system according to a twelfth aspect is an air conditioning system comprising a plurality of indoor units that jointly air conditions a same space, comprising a first indoor unit and a second indoor unit. The first indoor unit comprises a first temperature adjusting unit that adjusts the temperature in the space. The second indoor unit comprises a second temperature adjusting unit and a humidity adjusting unit. The second temperature adjusting unit adjusts the temperature in the space. The humidity adjusting unit adjusts the humidity in the space. Further, in accordance with the operation state of the first indoor unit, the second indoor unit switches between either a temperature adjustment mode or a humidity adjustment mode. In the temperature adjustment mode, the temperature in the space is adjusted by the second temperature adjusting unit. In the humidity adjustment mode, the humidity in the space is adjusted by the humidity adjusting unit.

With this air conditioning system, the second indoor unit switches between the temperature adjustment mode and the humidity adjustment mode in accordance with the operation state of the first indoor unit. Consequently, operation can be performed in accordance with the operation state of the first indoor unit. For example, if the need for humidity adjustment is low due to the operation state of the first indoor unit, then the second indoor unit transitions to the temperature adjustment mode; if the need for humidity adjustment is high, then the second indoor unit can transition to the humidity adjustment mode. Thereby, the humidity can be appropriately adjusted with this air conditioning system.

The air conditioning system according to a thirteenth aspect is the air conditioning system as recited in the twelfth aspect, wherein in the temperature adjustment mode, the output of the second indoor unit is controlled based on the temperature in the space. In addition, in the humidity adjustment mode, the output of the second indoor unit is controlled based on the humidity in the space.

Furthermore, control of output recited here is not only the control of the output of the current, the voltage, and the like, but also includes the control of the constituent parts that constitute the second indoor unit, such as the fan, the flap, the motor operated valve, and the like.

With this air conditioning system, output in the second indoor unit is controlled based on the temperature during temperature adjustment, and output is controlled based on the humidity in the humidity adjustment mode. Consequently, it is possible, in accordance with the operation state of the first indoor unit, to switch between the case of giving priority to temperature adjustment of the room and the case of giving priority to humidity adjustment. Thereby, the temperature and the humidity can be appropriately adjusted with this air conditioning system.

The air conditioning system according to a fourteenth aspect is the air conditioning system as recited in the thirteenth aspect, wherein the second indoor unit comprises a second indoor fan and a second control unit. The second indoor fan sends humidity-adjusted or temperature-adjusted air to the space. The second control unit controls the second indoor fan based on the temperature in the space in the temperature adjustment mode, and controls the second indoor fan based on the humidity in the space in the humidity adjustment mode.

With this air conditioning system, the second control unit controls the second indoor fan based on the temperature in the space in the temperature adjustment mode. Consequently, the temperature in the room can be made appropriate. In addition, the second control unit controls the second indoor fan based on the humidity in the space in the humidity adjustment mode. Consequently, the humidity in the room can be made appropriate. Thus, with this air conditioning system, the humidity and the humidity in the room can be made appropriate.

The air conditioning system according to a fifteenth aspect is the air conditioning system as recited in the fourteenth aspect, wherein the second indoor unit further comprises a humidity sensor that detects the humidity in the space. Further, the second control unit controls the second indoor fan based on the humidity detected by the humidity sensor in the humidity adjustment mode.

With this air conditioning system, the second indoor unit comprises the humidity sensor, and the second indoor fan is controlled based on the humidity detected by the humidity sensor. Consequently, with this air conditioning system, the humidity in the room can be accurately detected, and the humidity in the room can be adjusted.

The air conditioning system according to a sixteenth aspect is the air conditioning system as recited in any one the twelfth through fifteenth aspects, further comprising a detecting means that detects the operation state of the first indoor unit. Furthermore, it is acceptable for the detecting means to be located outside or inside the second indoor unit.

With this air conditioning system, the detecting means detects the operation state of the first indoor unit. Consequently, the operation state of the first indoor unit can be accurately ascertained. Thereby, with this air conditioning system, operation can be performed in accordance with the operation state of the first indoor unit.

The air conditioning system according to a seventeenth aspect is the air conditioning system as recited in the sixteenth aspect, further comprising a selecting means. The selecting means selects between the temperature adjustment mode and the humidity adjustment mode in accordance with the operation state of the first indoor unit detected by the detecting means. Furthermore, it is acceptable for the selecting means to be located outside or inside the second indoor unit.

With this air conditioning system, the selecting means selects between the temperature adjustment mode and the humidity adjustment mode. Thereby, operation can be performed in accordance with the operation state of the first indoor unit.

The air conditioning system according to an eighteenth aspect is the air conditioning system as recited in the sixteenth or seventeenth aspects, wherein the first temperature adjusting unit of the first indoor unit has a heating function, and the humidity adjusting unit of the second indoor unit has a humidifying function. In addition, the detecting means detects whether the first indoor unit is performing the heating operation. Furthermore, if it is detected that the first indoor unit is performing the heating operation, then the second indoor unit humidifies the space in the humidity adjustment mode.

With this air conditioning system, the detecting means detects whether the first indoor unit is performing the heating operation. Furthermore, if the first indoor unit is performing the heating operation, then the second indoor unit humidifies the space in the humidity adjustment mode. Thereby, with this air conditioning system, the humidity in the space can be appropriately adjusted during the heating operation, which tends to dry out the air in the room.

The air conditioning system according to a nineteenth aspect is the air conditioning system as recited in the eighteenth apsect, wherein the first temperature adjusting unit of the first indoor unit further has a cooling function, and the second temperature adjusting unit of the second indoor unit further has a cooling function. In addition, the detecting means detects whether the first indoor unit is performing the heating operation or the cooling operation. Furthermore, the second indoor unit humidifies the space in the humidity adjustment mode if it is detected that the first indoor unit is performing the heating operation, and cools the space in the temperature adjustment mode if it is detected that the first indoor unit is performing the cooling operation.

With this air conditioning system, the detecting means detects whether the first indoor unit is performing the heating operation or the cooling operation. Furthermore, if the first indoor unit is performing the heating operation, then the second indoor unit performs the humidifying operation in the humidity adjustment mode. Thereby, the humidity in the space can be appropriately adjusted during the heating operation, which tends to dry out the air in the room. In addition, if the first indoor unit is performing the cooling operation, then the second indoor unit performs the cooling operation in the temperature adjustment mode. Thereby, the second indoor unit performs the cooling operation together with the first indoor unit during the cooling operation, which has a low need for humidification. As discussed above, with this air conditioning system, the second indoor unit can be made to function efficiently for both the case in which the first indoor unit is performing the heating operation and the case in which it is performing the cooling operation.

The air conditioning system according to a twentieth aspect is the air conditioning system as recited in any one of the first through nineteenth aspects, wherein the first indoor unit does not have a humidity adjustment function. In addition, the air conditioning system further comprises a transport pathway. The transport pathway is connected to the second indoor unit, and conveys water for humidity adjustment from a water source to the second indoor unit.

With this air conditioning system, water for adjusting the humidity can be conveyed to the second indoor unit by the transport pathway. In addition, with this air conditioning system, there is no need to connect the transport pathway to the first indoor unit because the first indoor unit does not have a humidity adjustment function. Consequently, with this air conditioning system, the construction cost of the transport pathway is reduced.

The air conditioning system according to a twenty-first aspect is the air conditioning system as recited in any one of the first through third aspects, and the twelfth aspect, comprising m ($m \geqq 2$) units of indoor units that include the first indoor unit and the second indoor unit, and that air condition the prescribed space. With this air conditioning system, among the indoor units, at least n ($1 \leqq n \leqq m-1$) units of the indoor units, including the first indoor unit, have a heating function. In addition, the total heating capacity of the n units of the indoor units satisfies the required heating capacity needed for the heating load of the space. Furthermore, at least m−n units of the indoor units, including the second indoor unit, have a humidifying function, and m−n units of the indoor units perform the humidifying operation in the humidifying operation mode wherein control is performed based on the humidity.

Furthermore, the heating capacity is the amount of heat that can be added per unit of time to the space, and is the one referred to when selecting the model of the indoor unit.

In a conventional air conditioning system, it is often the case that each indoor unit operates principally to perform temperature adjustment, and a case arises in which the humidity is not appropriately adjusted. To raise an example of the above, each indoor unit performs temperature adjustment together with humidity adjustment, but each indoor unit may transition to the thermo-off state in order to perform temperature adjustment. In the thermo-off state, humidified air is no longer sent to the room because the indoor fan is stopped. Consequently, the humidity in the room becomes insufficiently adjusted. Particularly in an office where there is a large amount of heat generated from equipment, such as personal computers, the thermo-off state often persists because the heating load on the air conditioner is small. Consequently, the case arises in which the appropriate amount of humidification is not ensured, and the humidity is not appropriately adjusted.

With this air conditioning system, at least m−n units of indoor units perform the humidifying operation in the humidifying operation mode, wherein control is performed based on the humidity. Consequently, for example, even if other indoor units have transitioned to the thermo-off state, the humidifying operation can be performed appropriately by at least m−n units of indoor units. Thereby, the humidity can be appropriately adjusted. In addition, with this air conditioning system, m units of indoor units are provided, which exceeds the n units that satisfy the required heating capacity, and, from the perspective of the heating capacity, the surplus m−n units of indoor units can perform the humidifying operation in the humidifying operation mode. Accordingly, even if m−n units of indoor units perform the humidifying operation in the humidifying operation mode, heating can be sufficiently performed by the n units of indoor units. Consequently, the system is effectively constituted without waste.

The air conditioning system according to a twenty-second aspect is the air conditioning system as recited in the twenty-first aspect, wherein m units of the indoor units have a cooling function. Furthermore, the total cooling capacity of the m units of the indoor units satisfies the required cooling capacity needed for the cooling load of the space.

Furthermore, the cooling capacity is the amount of heat that can be eliminated per unit of time from the space, and is the one referred to when selecting the model-of the indoor unit.

With this air conditioning system, the total cooling capacity of the m units of indoor units satisfies the required cooling capacity. Generally, if an indoor unit that performs cooling and heating is selected on the basis of the cooling capacity, then there is often a surplus of heating capacity. Particularly in offices where a large amount of heat is generated from equipment, such as personal computers, the heating load on the air conditioner is small, and a surplus of heating capacity often occurs compared with the cooling capacity. Furthermore, with this air conditioning system, while other indoor units perform the heating operation, at least m−n units of indoor units can perform the humidifying operation in the humidifying operation mode. Accordingly, the system is constituted effectively without waste, and can perform humidity adjustment appropriately.

The air conditioning system according to a twenty-third aspect is the air conditioning system as recited in the twenty-second aspect, wherein n units of the indoor units are cooling and heating units that perform the heating operation and the cooling operation. In addition, m−n units of the indoor units are cooling and humidifying units that perform the cooling operation and the humidifying operation.

With this air conditioning system, n units from among m units of the indoor units are cooling and heating units, and m−n units are cooling and humidifying units. Consequently, during the heating season, such as in the winter, the heating operation is performed by the cooling and heating units that satisfy the required heating capacity, and the humidifying operation can be performed by the cooling and humidifying units. Thereby, the space can be maintained at an appropriate humidity during the heating season, when the humidity tends to drop. In addition, during the cooling season, both the cooling and heating units and the cooling and humidifying units can perform the cooling operation. Thereby, during the cooling season, an appropriate temperature can be maintained in the space.

The air conditioning system according to a twenty-fourth aspect is the air conditioning system as recited in any one of the first through third aspects, and the twelfth aspect, that air conditions the prescribed space. This air conditioning system comprises a cooling and heating unit group and a cooling and humidifying unit group. The cooling and heating unit group has a first cooling capacity and a first heating capacity, and includes one or a plurality of cooling and heating units that include the first indoor unit and perform the heating operation and the cooling operation. The cooling and humidifying unit group has a second cooling capacity and includes one or a plurality of cooling and humidifying units that include the second indoor unit and perform the cooling operation and the humidifying operation. Furthermore the total cooling capacity, which is the sum of the first cooling capacity and the second cooling capacity, satisfies the required cooling capacity needed for the cooling load of the space. In addition, the first heating capacity satisfies the required heating capacity needed for the heating load of the space. Furthermore, the humidifying operation of the cooling and humidifying unit is performed in a humidifying operation mode wherein control is performed based on the humidity.

With this air conditioning system, the cooling and humidifying unit performs the humidifying operation in the humidifying operation mode, wherein control is performed based on the humidity. Consequently, even if the cooling and heating unit transitions to the thermo-off state, the humidifying operation can be appropriately performed by the cooling and humidifying unit. Thereby, the humidity can be appropriately adjusted. In addition, with this air conditioning system, the total cooling capacity, which is the sum of the first cooling capacity of the cooling and heating unit group and the second cooling capacity of the cooling and humidifying unit group, satisfies the required cooling capacity. In addition, the first heating capacity of the cooling and heating unit group satisfies the required heating capacity. Accordingly, the cooling and heating unit satisfies the required heating capacity, and, from the perspective of the heating capacity, the surplus cooling and humidifying unit can perform the humidifying operation in the humidifying operation mode. Consequently, even if the cooling and humidifying unit is performing the humidifying operation in the humidifying operation mode, the cooling and heating unit can sufficiently perform heating. Thus, with this air conditioning system, the system is effectively constituted without waste.

The air conditioning system according to a twenty-fifth aspect is the air conditioning system as recited in the twenty-third or twenty-fourth aspects, wherein the cooling and heating unit performs control related to the heating operation based on the temperature in the space. In addition, in the humidifying operation mode, the cooling and humidifying unit performs control related to the humidifying operation based on the humidity in the space.

With this air conditioning system, the cooling and humidifying unit performs control related to the humidifying operation based on the humidity in the space in the humidifying operation mode, in contrast to the cooling and heating unit, which performs control related to the heating operation based on the temperature in the space. Generally, if the heating operation is being performed, the humidity in the room tends to drop. However, with this air conditioning system, the cooling and heating unit appropriately heats the space, and the cooling and humidifying unit appropriately humidifies the space. Thereby, with this air conditioning system, the temperature and the humidity can be appropriately adjusted during heating.

The air conditioning system according to a twenty-sixth aspect is the air conditioning system as recited in any one of the twenty-third through twenty-fifth aspects, wherein the cooling and heating unit performs control related to the cooling operation based on the temperature in the space. In addition, the cooling and humidifying unit performs control related to the cooling operation based on the temperature in the space.

With this air conditioning system, the cooling and heating unit and the cooling and humidifying unit perform control related to the cooling operation based on the temperature in the space. Accordingly, during cooling when the need for humidification is low, both the cooling and heating unit and the cooling and humidifying unit can appropriately perform the cooling operation, and the cooling operation can thereby be effectively performed.

The air conditioning system according to a twenty-seventh aspect is the air conditioning system as recited in any one of the twenty-third through twenty-sixth aspects, wherein the cooling and heating unit comprises a first indoor fan and a first control unit. The first indoor fan sends air to the space. The first control unit, in the heating operation, controls the first indoor fan based on the temperature in the space. In addition, the cooling and humidifying unit comprises a second indoor fan and a second control unit. The second indoor fan sends air to the space. The second control unit, in the humidifying operation mode, controls the second indoor fan based on the humidity in the space.

With this system, the first control unit of the cooling and heating unit controls the first indoor fan based on the temperature in the space in the heating operation. In addition, the second control unit of the cooling and humidifying unit controls the second indoor fan based on the humidity in the space in the humidifying operation mode. Consequently, the cooling and heating unit can appropriately heat the room, and the cooling and humidifying unit can appropriately humidify the room.

The air conditioning system according to a twenty-eighth aspect is the air conditioning system as recited in the twenty-seventh aspect, wherein the first control unit controls the first indoor fan based on the temperature in the space in the cooling operation. In addition, the second control unit controls the second indoor fan based on the temperature in the space in the cooling operation.

With this air conditioning system, the first control unit of the cooling and heating unit and the second control unit of the cooling and humidifying unit control the first indoor fan and the second indoor fan based on the temperature in the space in the cooling operation. Accordingly, during cooling when the need for humidification is low, both the cooling and heating unit and the cooling and humidifying unit can appropriately perform the cooling operation, and the cooling operation can thereby be effectively performed.

The air conditioning system according to a twenty-ninth aspect is the air conditioning system as recited in any one of the twenty-first through twenty-third aspects, wherein if at least one unit of the indoor units is performing the heating operation, then m−n units of the indoor units perform the humidifying operation in the humidifying operation mode.

With this system, if at least one indoor unit is performing the heating operation, then the m−n indoor units automatically perform the humidifying operation in the humidifying operation mode. Consequently, with this air conditioning system, the humidity in the space can be appropriately adjusted when performing the heating operation, in which the humidity tends to drop.

The air conditioning system according to a thirtieth aspect is the air conditioning system as recited in any one of the twenty-third through twenty-eighth aspects, further comprising a detecting means. The detecting means detects whether the cooling and heating unit is performing the heating operation or the cooling operation. Furthermore, if it is detected that the cooling and heating unit is performing the heating operation, then the cooling and humidifying unit performs the humidifying operation in the humidifying operation mode, and performs the cooling operation if it is detected that the cooling and heating unit is performing the cooling operation.

With this air conditioning system, the detecting means detects whether the cooling and heating unit is performing the heating operation or the cooling operation. Furthermore, if the cooling and heating unit is performing the heating operation, the cooling and humidifying unit performs the humidifying operation in the humidifying operation mode. Thereby, during the heating operation when the humidity tends to drop, the humidity in the space can be appropriately adjusted. In addition, if the cooling and heating unit is performing the cooling operation, then the cooling and humidifying unit performs the cooling operation. Thereby, during the cooling operation when the need for humidification is low, the cooling and humidifying unit performs the cooling operation together with the cooling and heating unit. As described above, with this air conditioning system, in both the case wherein the cooling and heating unit is performing the heating operation and the case wherein it is performing the cooling operation, the cooling and humidifying unit can be made to function efficiently.

The air conditioning system according to a thirty-first aspect is the air conditioning system as recited in any one of the twenty-third through twenty-eighth aspects, wherein the cooling and heating unit and the cooling and humidifying unit each comprises a heat exchanger. The heat exchanger constitutes a portion of a refrigeration cycle wherein the refrigerant circulates, and switches between its role as an evaporator and its role as a condenser as the direction of circulation of the refrigerant changes.

With this system, cooling and heating are switched by changing the direction of the circulation of the refrigerant flowing in the refrigeration cycle, which includes the heat exchanger of the cooling and heating unit and the heat exchanger of the cooling and humidifying unit. Furthermore, with a refrigeration cycle wherein the refrigerant switches in this manner, a differential between the cooling capacity and the heating capacity tends to arise. Accordingly, if the cooling and heating unit is selected on the basis of the cooling capacity, then a surplus in the heating capacity often occurs. Consequently, the present invention, wherein the cooling and humidifying unit performs the humidifying operation in the humidifying operation mode, is more effective.

The air conditioning system according to a thirty-second aspect is the air conditioning system as recited in the thirty-first aspect, wherein the cooling and humidifying unit further comprises a humidifier unit. The humidifier unit humidifies the air by releasing moisture into the air that passes therethrough. Furthermore, the humidifier unit performs the humidifying operation by passing through the humidifier unit the air that was heated by the heat exchanger.

With this air conditioning system, the cooling and humidifying unit performs the humidifying operation by passing through the humidifier unit the air that was heated by the heat exchanger. If the heating operation is being performed, then the air that passes through the heat exchanger of the cooling and humidifying unit is heated. Furthermore, by passing the heated hot air through the humidifier unit, that air is humidified by the moisture of the humidifier unit released into the air. In addition, with this air conditioning system, the heating capacity is satisfied by the cooling and heating unit. Consequently, even if the air that passes through the heat exchanger of the cooling and humidifying unit is used for humidification, there is little risk that the heating capacity will be insufficient. Thus, with this air conditioning system, the system is constituted effectively and without waste.

The air conditioning system according to a thirty-third aspect is the air conditioning system as recited in any one of the twenty-first through twenty-third aspects, wherein the total humidifying capacity of m−n units of the indoor units satisfies the prescribed required humidifying capacity demanded to humidify the space. In addition, n units of the indoor units do not have a humidifying function.

With this air conditioning system, the total humidifying capacity of the m−n indoor units satisfies the required humidifying capacity, and the n indoor units do not have a humidifying function. In other words, the humidifying function is aggregated in the m−n indoor units. Furthermore, the m−n indoor units, wherein the humidifying function is aggregated, perform the humidifying operation in the humidifying operation mode. Consequently, there is no need to provide a humidifying unit, and the like, for supplementing the other indoor units with a humidifying function. Accordingly, with this air conditioning system, the system can be constituted at a low cost.

The air conditioning system according to a thirty-fourth aspect is the air conditioning system as recited in any one of the twenty-fourth through thirty-second aspects, wherein the total humidifying capacity of the cooling and humidifying unit satisfies the prescribed required humidifying capacity demanded to humidify the space. In addition, the cooling and heating unit does not have a humidifying function.

With this air conditioning system, the total humidifying capacity of the cooling and humidifying unit satisfies the required humidifying capacity, and the cooling and heating unit does not have a humidifying function. In other words, the humidifying function is aggregated in the indoor unit that is the cooling and humidifying unit. Furthermore, the cooling and humidifying unit, wherein the humidifying function is aggregated, performs the humidifying operation in the humidifying operation mode. Consequently, there is no need to provide a humidifying unit, and the like, for providing the cooling and heating unit with a humidifying function. Accordingly, the system can be constituted at a low cost.

BRIEF EXPLANATION OF DRAWINGS

FIG. 4(*b*) is a side view of the second indoor unit.

DETAILED DESCRIPTION OF THE PREFERRED EMBODIMENTS

<Constitution of the Entire Air Conditioning System>

Figure 1:
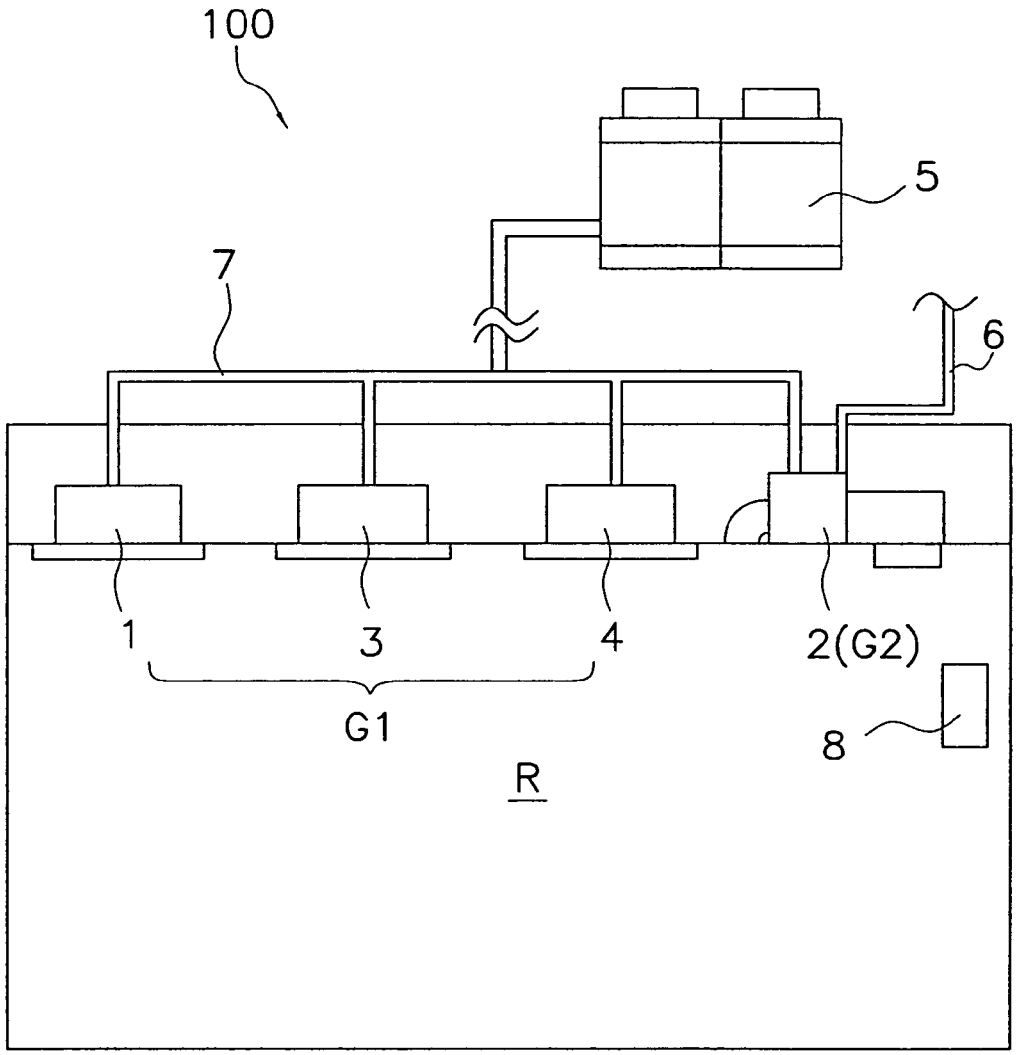
FIG. 1 is a schematic drawing of the entire air conditioning system.

FIG. 1 depicts an air conditioning system 100 wherein one embodiment of the present invention is adopted.

In the air conditioning system 100, a plurality of indoor units 1-4 is connected to an outdoor unit 5, and the plurality of indoor units 1-4 air conditions the same room R (the space). The following describes the air conditioning system 100, wherein four indoor units 1-4 are connected to the outdoor unit 5 as an example, but the number of outdoor units 5 and indoor units is not limited thereto.

The air conditioning system 100 comprises the outdoor unit 5, the four indoor units 1-4, a water piping 6 (transport pathway), a controller 8, and the like. The outdoor unit 5 is disposed outside, such as on the roof of the building where the air conditioning system 100 is disposed. The four indoor units 1-4 are disposed in the vicinity of the ceiling of the same room R, and jointly air condition the room R. A refrigerant piping 7 and an outdoor unit communication wire [85] connect each of the indoor units 1-4 to the outdoor unit 5. In addition, the indoor units 1-4 include the first indoor unit 1 (an indoor unit and a cooling and heating unit), the third indoor unit 3 (an indoor unit and a cooling and heating unit) and the fourth indoor unit 4 (an indoor unit and a cooling and heating unit), which principally cools and heats, as well as the second indoor unit 2 (an indoor unit and a cooling and humidifying unit), which principally cools and humidifies the room R. The controller 8 is disposed on a sidewall, and the like, of the room R, and performs setup of the air conditioning operation of the room, such as the cooling operation and the heating operation selection, the temperature, the humidity, and the air volume.

Figure 2:
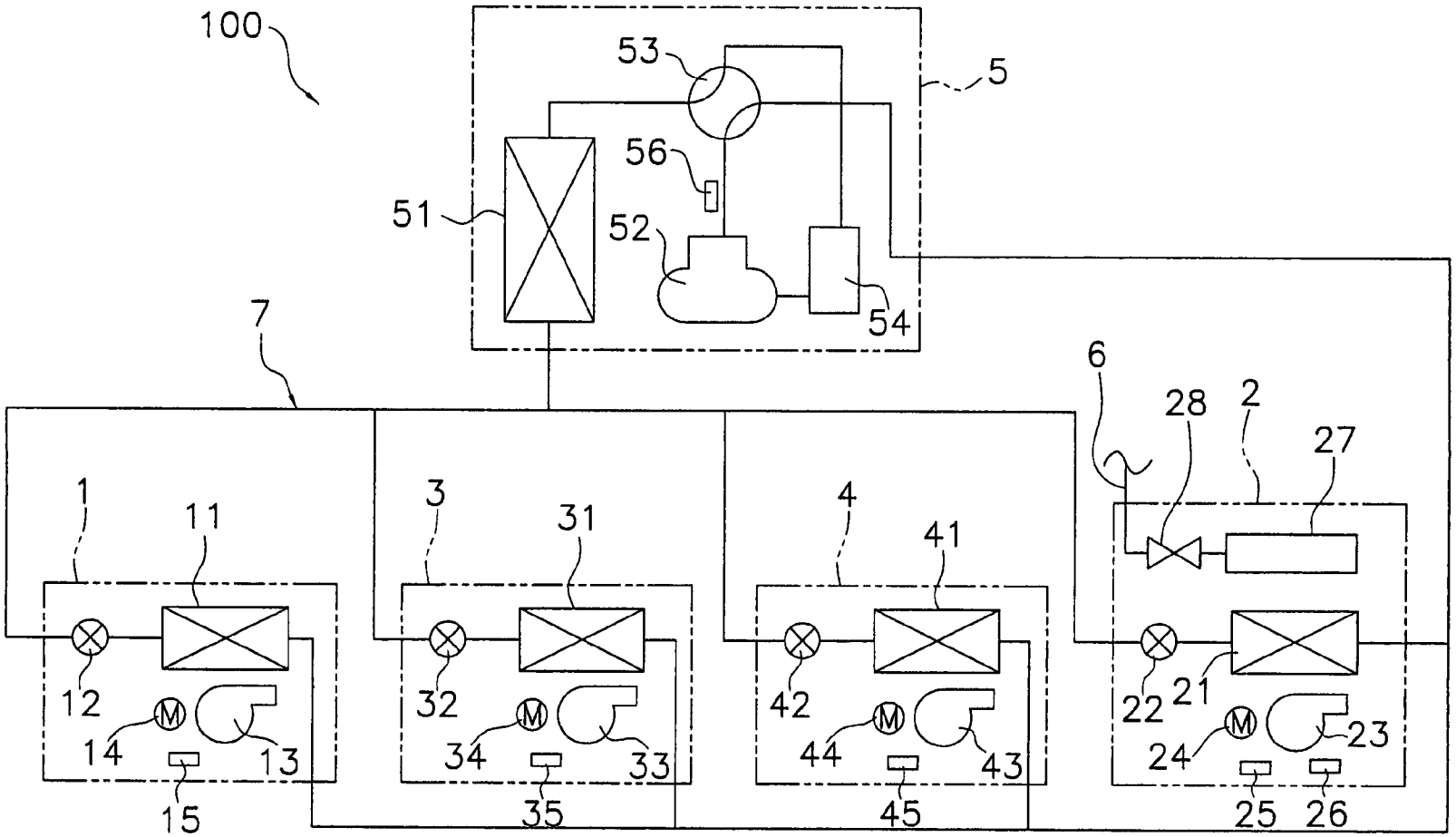
FIG. 2 is a schematic drawing of the refrigerant circuit and the constitution of the air conditioning system.

FIG. 2 shows a schematic of the refrigerant circuit and the constitution of the present air conditioning system 100. The refrigerant circuit comprises one outdoor unit 5, to which are connected in parallel the first indoor unit 1, the second indoor unit 2, the third indoor unit 3 and the fourth indoor unit 4.

<Constitution of the Outdoor Unit>

The outdoor unit 5 comprises an outdoor heat exchanger 51, a compressor 52, a four-way switching valve 53, an accumulator 54, a discharge pipe thermistor 56, an outdoor control unit 57 (refer to FIG. 3), and the like.

The outdoor heat exchanger 51, the compressor 52, the four-way switching valve 53, and the accumulator 54 constitute the refrigerant circuit with the indoor units 1-4; and the four-way switching valve 53 switches the flow of the refrigerant when cooling and when heating.

The discharge pipe thermistor 56 is affixed to the discharge side of the compressor 52, and detects the discharge pipe temperature on the discharge side of the compressor 52.

Figure 3:
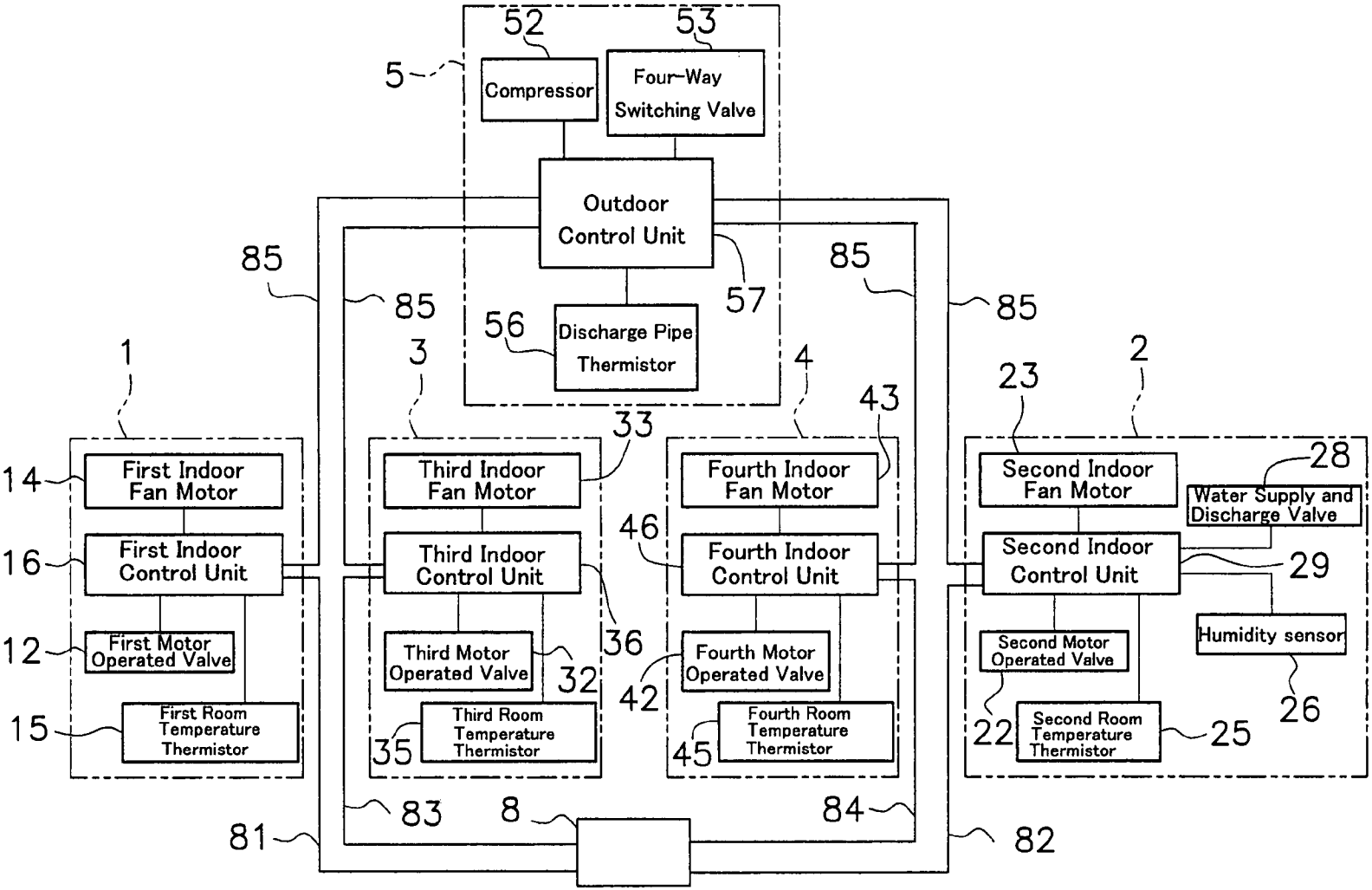
FIG. 3 is a control block diagram of the air conditioner system.

The outdoor control unit 57 comprises a microprocessor, ROM, RAM, various interfaces, and the like. As shown in FIG. 3, the discharge pipe thermistor 56 is connected to the outdoor control unit 57 and the detection signal of the discharge pipe thermistor 56 is inputted thereinto. In addition, the compressor 52, the four-way switching valve 53, and the like, are also connected to the outdoor control unit 57, which controls the air conditioning operation by controlling the operation frequency of the compressor 52 in accordance with various conditions during operation.

<Constitution of the Indoor Unit>

The indoor units 1, 3, 4 are each a cooling and heating unit, having a cooling function and a heating function, and constitute a cooling and heating unit group G1. A cooling and heating unit is a unit that performs cooling and heating. The room R is provided with three units; the first indoor unit 1, the third indoor unit 3 and the fourth indoor unit 4. In addition, the first indoor unit 1, the third indoor unit 3 and the fourth indoor unit 4 respectively comprise a prescribed heating capacity and a prescribed cooling capacity.

The second indoor unit 2 is a cooling and humidifying unit that cools and humidifies the room R, and constitutes a cooling and humidifying unit group G2. In addition, the second indoor unit 2 has a prescribed cooling capacity and a prescribed humidifying capacity.

Here, the total heating capacity and the total cooling capacity of the indoor units 1, 3, 4 that constitute the cooling and heating unit group G1 are respectively defined as a first heating capacity and a first cooling capacity. In addition, the total cooling capacity and the total humidifying capacity of the indoor unit 2 that constitutes the cooling and humidifying unit group G2 are respectively defined as a second cooling capacity and a total humidifying capacity. In other words, in the present embodiment, the first heating capacity and the first cooling capacity are the total of each heating capacity and the total of each cooling capacity of the first indoor unit 1, the third indoor unit 3 and the fourth indoor unit 4. In addition, the second cooling capacity and the total humidifying capacity are the cooling capacity and the humidifying capacity of the second indoor unit 2. Further, the first heating capacity satisfies the required heating capacity needed for the heating load of the room R. In addition, the total cooling capacity, which is the sum of the first cooling capacity and the second cooling capacity, satisfies the required cooling capacity needed for the cooling load of the room R. Furthermore, the total humidifying capacity satisfies the required humidifying capacity needed for the room R.

Furthermore, the heating capacity is the amount of heat that can be added per unit of time to the room R, and is the one referred to when selecting the model of the indoor unit. The cooling capacity is the amount of heat that can be removed per unit of time from the room R, and is the one referred to when selecting the model of the indoor unit. The heating capacity and the cooling capacity are measured, for example, under the conditions indicated in JISB8616, and are normally expressed in kW. In addition, the cooling load is the amount of heat that the indoor unit must remove when cooling the room and the like, and the heating load is the amount of heat that the indoor unit must provide when heating the room and the like. These are the loads prescribed by the installation environment of the indoor unit. The cooling load and the heating load are calculated by considering factors such as the exit and entrance of heat due to the structure of the building in which the indoor unit is disposed, and the heat generated in the room due to the number of people present in the room, the lighting, and the like. The humidifying capacity is the amount of moisture that can be humidified per unit of time, and is generally expressed in kg/h. The required humidifying capacity is calculated based on the amount of ventilation in the room R, the target absolute humidity in the room R, the outdoor absolute humidity, and the like.

<Constitution of the First Indoor Unit, the Third Indoor Unit and the Fourth Indoor Unit>

The first indoor unit, the third indoor unit and the fourth indoor unit are units that perform cooling and heating, as discussed above, and perform control related to the heating operation and the cooling operation, based on the temperature in the room R.

The first indoor unit 1 comprises a first indoor heat exchanger 11 (a first temperature adjusting unit and a heat exchanger), a first motor operated valve 12, a first indoor fan 13, a first indoor fan motor 14, a first room temperature thermistor 15, a first communication wire 81 (refer to FIG. 3), a first indoor control unit 16 (a first control unit) (refer to FIG. 3), and the like.

The first indoor heat exchanger 11 and the first motor operated valve 12 are connected in series, and constitute the refrigerant circuit with the outdoor unit 5. The first indoor heat exchanger 11 exchanges heat with the air that passes therethrough, thereby adjusting the temperature of the air sent to the room R. The first indoor heat exchanger 11 switches between its role as an evaporator and its role as a condenser as the direction of circulation of the refrigerant that circulates in a refrigeration cycle changes. Cooling and heating are thereby switched. The first motor operated valve 12 adjusts the amount of refrigerant flowing to the first indoor heat exchanger 11.

The first indoor fan motor 14 drives the first indoor fan 13. The first indoor fan 13 takes into the first indoor unit 1 the air from the room R wherein the first indoor unit 1 is disposed, and sends to the room R the air that was heat exchanged by the first indoor heat exchanger 11. Accordingly, the first indoor fan 13 sends to the room R the air that was heated by the first indoor heat exchanger 11 during heating, and sends to the room R the air that was cooled by the first indoor heat exchanger 11 during cooling.

The first room temperature thermistor 15 is provided in the vicinity of an inlet, wherethrough passes air that is taken into the first indoor unit 1, detects the temperature in the room R, and sends the detection signal to the first indoor control unit 16.

As shown in FIG. 3, the first communication wire 81 connects the controller 8 to the first indoor control unit 16, and transmits to the first indoor control unit 16 a signal related to the setting of the air conditioning operation that was input to the controller 8. The settings of this air conditioning operation include, for example, an instruction to perform the cooling operation, an instruction to perform the heating operation, the set temperature, the air volume, the wind direction, and the like.

The first indoor control unit 16 comprises a microprocessor, ROM, RAM, various interfaces, and the like. The first indoor control unit 16 is connected to the controller 8 by the first communication wire 81, and receives a signal related to the setting of the air conditioning operation from the controller 8. In addition, the first motor operated valve 12, the first indoor fan motor 14 and the first room temperature thermistor 15 are connected to the first indoor control unit 16 and the detection signal of the first room temperature thermistor 15 is inputted thereinto. In addition, the first indoor control unit 16 transmits a control signal to the first motor operated valve 12 and the first indoor fan motor 14 to adjust the temperature in the room R.

An outdoor unit communication wire 85 is provided between the outdoor control unit 57 and the first indoor control unit 16, and various signals, such as the control signal, can be transmitted to and received from the first indoor fan motor 14, and the like, via this outdoor unit communication wire 85.

In addition, based on the temperature in the room R, the outdoor control unit 57 and the first indoor control unit 16 perform the thermo-off operation and the thermo-on operation to adjust the temperature in the room R. During the thermo-off operation, the outdoor control unit 57 stops the operation of the compressor 52. In addition, the first indoor control unit 16 drops the output of the first indoor fan motor 14 to the minimum level so as to operate the first indoor fan 13 at the minimum required level. During the thermo-on operation, the outdoor control unit 57 reactivates the compressor 52. The first indoor control unit 16 returns the output control of the first indoor fan motor 14 to normal control.

The third indoor unit 3 comprises a third indoor heat exchanger 31, a third motor operated valve 32, a third indoor fan 33, a third indoor fan motor 34, a third room temperature thermistor 35, a third communication wire 83 (refer to FIG. 3), a third indoor control unit 36 (refer to FIG. 3), and the like. In addition, the fourth indoor unit 4 comprises a fourth indoor heat exchanger 41, a fourth motor operated valve 42, a fourth indoor fan 43, a fourth indoor fan motor 44, a fourth room temperature thermistor 45, a fourth communication wire 84 (refer to FIG. 3), a fourth indoor control unit 46 (refer to FIG. 3), and the like. All constituent parts of the third indoor unit 3 and the fourth indoor unit 4 are the same as the constituent parts of the first indoor unit 1. In addition, the outdoor unit 5 is connected to the third indoor unit 3 and the fourth indoor unit 4, the same as the first indoor unit 1, and performs the thermo-on operation and the thermo-off operation, the same as the first indoor unit 1.

<Constitution of the Second Indoor Unit>

Figure 4A:
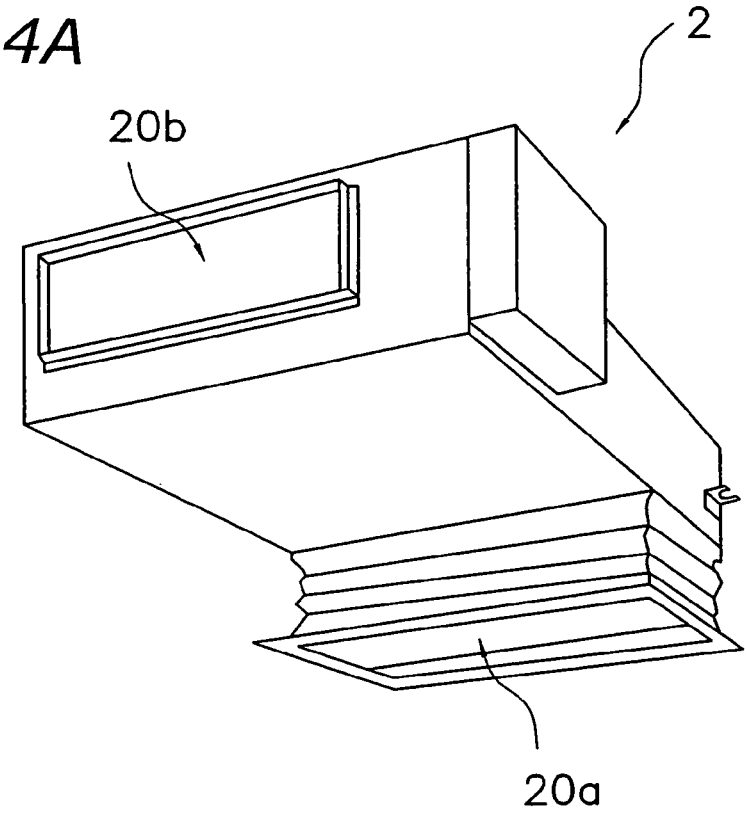
FIG. 4(*a*) is an exterior perspective view of a second indoor unit.
Figure 4B:
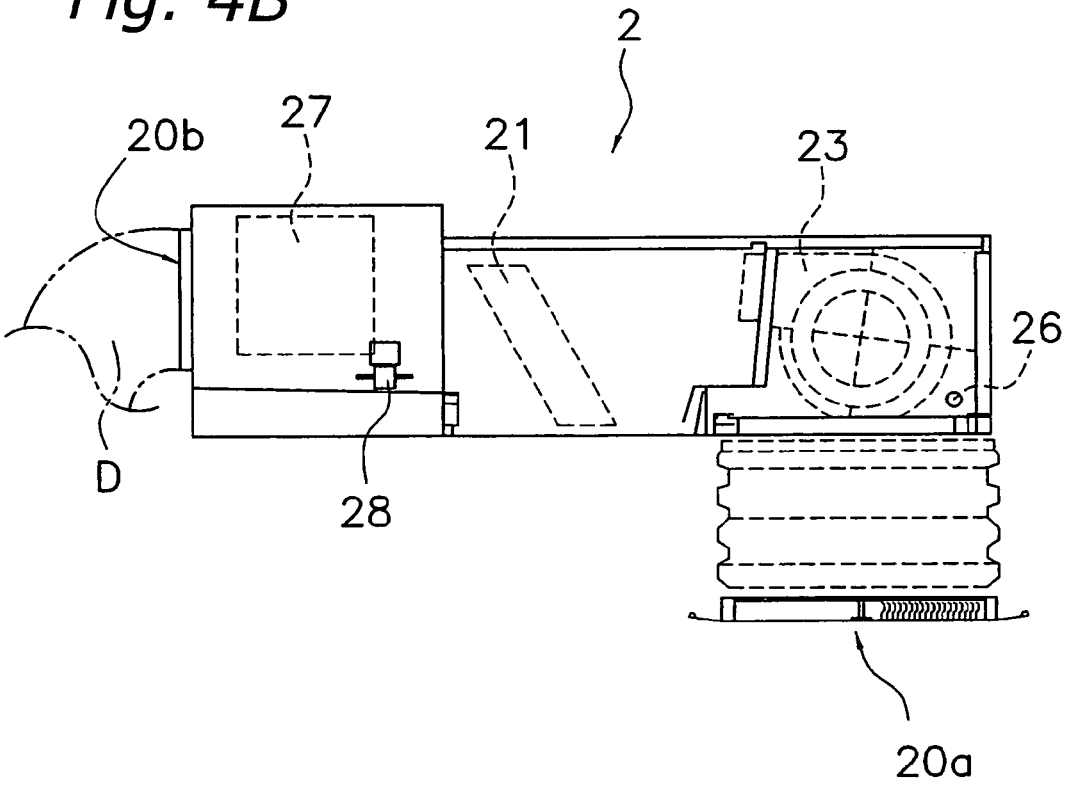

FIG. 4(*a*) is a perspective view of the second indoor unit 2. The second indoor unit 2 is a unit specialized for humidifying, and has a humidification performance that can adjust the humidity in the room R with one unit. The second indoor unit 2 performs a humidifying operation during the heating season, and a cooling operation during the cooling season. The second indoor unit 2 switches to an operation mode in accordance with the operation state of the other indoor units 1, 3, 4. The operation state of the other indoor units 1, 3, 4 is either in the heating operation or the cooling operation, and the second indoor unit 2 transitions to a humidity adjustment mode (humidifying operation mode) and performs the humidifying operation when the other indoor units 1, 3, 4 are performing the heating operation. In addition, the second indoor unit 2 transitions to a temperature adjustment mode and performs the cooling operation when the other indoor units 1, 3, 4 are performing the cooling operation. Furthermore, the humidity adjustment mode is an operation mode wherein the second indoor unit is controlled based on the humidity in the room R, and humidity adjustment is given priority over temperature adjustment in the room R. The temperature adjustment mode is an operation mode wherein the second indoor unit is controlled based on the temperature in the room R.

The second indoor unit 2 comprises a second indoor heat exchanger 21 (a second temperature adjusting unit and a heat exchanger), a second motor operated valve 22, a second indoor fan 23, a second indoor fan motor 24, a second room temperature thermistor 25, a humidity sensor 26, a humidifying element 27 (a humidity adjusting unit and a humidifier unit), a water supply and discharge valve 28, a second communication wire 82 (a detecting means) (refer to FIG. 3), a second indoor control unit 29 (a second control unit) (refer to FIG. 3), and the like.

The second indoor heat exchanger 21 and the second motor operated valve 22 are connected in series, and constitute the refrigerant circuit with the outdoor unit 5. The second indoor heat exchanger 21 exchanges heat with the air that passes therethrough, thereby adjusting the temperature of the air. The second indoor heat exchanger 21 switches between its role as an evaporator and its role as a condenser as the direction of the circulation of refrigerant that circulates in the refrigeration cycle changes. During the cooling operation, the second indoor heat exchanger 21 functions as an evaporator. In addition, during the humidifying operation, the second indoor heat exchanger 21 functions as a condenser. During the humidifying operation, the air that was heated by the second indoor heat exchanger 21 is humidified by passing through the humidifying element 27. The second motor operated valve 22 adjusts the amount of refrigerant flowing to the second indoor heat exchanger 21.

The second indoor fan motor 24 drives the second indoor fan 23. FIG. 4(*b*) is a side view of the second indoor unit 2. The second indoor fan 23 takes the air from the room R, wherein the second indoor unit 2 is disposed, into the second indoor unit 2 from an inlet 20*a*, and blows out from an outlet 20*b* the air that was heat exchanged by the second indoor heat exchanger 21, and the air that was humidified by the humidifying element 27. The air blown out from the outlet 20*b* is sent to the room R through a duct D. During humidification, the second indoor fan 23 sends to the room R the air that was heated by the second indoor heat exchanger 21 and humidified by the humidifying element 27. In addition, during cooling and not humidifying, the second indoor fan 23 sends to the room R the air that was cooled, but not humidified, by the second indoor heat exchanger 21.

The second room temperature thermistor 25 is provided in the vicinity of the inlet wherethrough passes the air taken into the second indoor unit 2, detects the temperature in the room R, and transmits the detection signal to the second indoor control unit 29 (refer to FIG. 2 and FIG. 3).

The humidity sensor 26 is provided in the vicinity of the inlet wherethrough passes the air taken into the second indoor unit 2, detects the humidity in the room R, and transmits the detection signal to the second indoor control unit 29.

The humidifying element 27 adjusts the humidity in the room R. The humidifying element 27 receives water from the water piping 6, and releases moisture into the air that passes therethrough. The water piping 6 is connected to a water source such as waterworks, and conveys water from the water source to the humidifying element 27. This humidifying element 27 is provided only in the second indoor unit 2, and is not disposed in the other indoor units: the first indoor unit 1, the third indoor unit 3 and the fourth indoor unit 4. In addition, the water piping 6 is also connected only to the second indoor unit 2, and is not connected to the first indoor unit 1, the third indoor unit 3 and the fourth indoor unit 4.

The water supply and discharge valve 28 is provided between the water piping 6 and the humidifying element 27, and adjusts the amount of water supplied to the humidifying element 27 and drained from the humidifying element 27. The water supply and discharge valve 28 is connected to the second indoor control unit 29, and is controlled by the second indoor control unit 29.

As shown in FIG. 3, the second communication wire 82 connects the controller 8 to the second indoor control unit 29, and transmits to the second indoor control unit 29 a signal related to the air conditioning operation settings input to the controller 8. These air conditioning operation settings include, for example, an instruction to perform the cooling operation, an instruction to perform the heating operation, the set humidity, and the like.

The second indoor control unit 29 comprises a microprocessor, ROM, RAM, various interfaces, and the like. The second indoor control unit 29 is connected to the controller 8 by the second communication wire 82, and receives a signal related to the air conditioning operation settings from the controller 8. Based on the signal transmitted by the second communication wire 82, the second indoor control unit 29 can detect whether the first indoor unit 1, the third indoor unit 3 and the fourth indoor unit 4 are performing the heating operation or the cooling operation. In addition, the second motor operated valve 22, the second indoor fan 23, the second room temperature thermistor 25, the humidity sensor 26, the water supply and discharge valve 28, and the like, are connected to the second indoor control unit 29 and the detection signals of the second room temperature thermistor 25 and the humidity sensor 26 are inputted thereinto. In addition, the outdoor unit communication wire 85 is provided between the outdoor control unit 57 and the second indoor control unit 29, and various signals, such as the control signal of the second motor operated valve 22, can be transmitted and received via this outdoor unit communication wire 85. If the second indoor control unit 29 receives a heating operation command signal from the controller 8 via the second communication wire 82, then it transitions to the humidity adjustment mode and performs the humidifying operation. In other words, the second indoor control unit 29 performs the humidifying operation if the first indoor unit 1, the third indoor unit 3 and the fourth indoor unit 4 are performing the heating operation. During the humidifying operation, the second indoor control unit 29 controls all constituent parts with priority given to adjusting the humidity in the room R, without the objective of adjusting the temperature in the room R. Specifically, in the humidity adjustment mode, the second indoor control unit 29 does not perform the thermo-on operation and the thermo-off operation based on the temperature in the room R, as does the first indoor unit 1 and the like, but controls the first indoor fan motor 14 and the water supply and discharge valve 28 based on the humidity in the room R detected by the humidity sensor 26. In addition, if the second indoor control unit 29 receives a cooling operation command signal from the controller 8 via the second communication wire 82, then it transitions to the temperature adjustment mode and performs the cooling operation. In other words, if the first indoor unit 1, the third indoor unit 3 and the fourth indoor unit 4 perform the cooling operation, then the second indoor control unit 29 also performs the cooling operation with them. In the temperature adjustment mode, the second indoor unit 2 cools the room [R] by performing the thermo-on operation and the thermo-off operation based on the temperature in the room R, the same as in the first indoor unit 1 and the like.

<Operation of the Indoor Unit>

The following explains the operation of the indoor units 1-4 in this air conditioner system 100 during cooling and heating.

<Operation During Heating Operation>

During the heating operation in this air conditioning system 100, the first indoor unit 1, the third indoor unit 3 and the fourth indoor unit 4 adjust the temperature in the room R, and the second indoor unit 2 adjusts the humidity in the room R.

If the first indoor unit 1, the third indoor unit 3 and the fourth indoor unit 4 receive a heating operation command signal from the controller 8, then they perform the heating operation. During the heating operation, the first indoor unit 1, the third indoor unit 3 and the fourth indoor unit 4 perform control by repetitively performing the thermo-on operation and the thermo-off operation so that the temperature in the room R approaches the set temperature. In performing this control, the first indoor unit 1 detects the temperature in the room R by the first room temperature thermistor 15. If the first indoor control unit 16 of the first indoor unit 1 judges that the detected room R temperature has risen to a fixed value, then it performs control so that it transitions to thermo-off. If it transitions to the thermo-off state, then the operation of the compressor 52 is stopped and the output of the first indoor fan motor 14 is dropped to the minimum level so as to operate the first indoor fan 13 at the minimum required level. If the temperature in the room R declines after thermo-off, then the first indoor control unit 16 transitions to thermo-on. If it transitions to the thermo-on state, then the compressor 52 is reactivated, and output control of the first indoor fan motor 14 is also returned to normal control, thereby restoring the heating operation.

Thus, the first indoor unit 1 performs the heating operation by repetitively performing thermo-on and thermo-off based on the temperature in the room R, thereby adjusting the temperature in the room R. The same applies to the third indoor unit 3 and the fourth indoor unit 4.

If the second indoor unit 2 receives a heating operation command signal via the second communication wire 82 from the controller 8, then it transitions to the humidity adjustment mode and performs the humidifying operation. In this case, while the first indoor unit 1, and the like, is adjusting the temperature in the room R, the second indoor unit 2 performs the humidifying operation independent of the thermo-on/thermo-off of the first indoor unit 1 and the like. During the humidifying operation, the second indoor unit 2 humidifies the room R based on the humidity in the room R detected by the humidity sensor 26. The second indoor control unit 29 of the second indoor unit 2 controls the water supply and discharge valve 28 and the second indoor fan motor 24 output based on the humidity in the room R, and the humidity in the room R thereby approaches the set humidity. During the humidifying operation, the water supply and discharge valve 28 supplies water to the humidifying element 27, and humidified air is generated by the second indoor fan 23, which the second indoor fan motor 24 drives. This humidified air is sucked into the second indoor unit 2 from the room R, is humidified by passing through the second indoor heat exchanger 21 and the humidifying element 27, and is blown out into the room R. Furthermore, even during this humidifying operation, the air that was heat exchanged by the second indoor heat exchanger 21 is heated, but this is for the purpose of humidification, and not for the purpose of heating.

As described above, during heating with this air conditioning system 100, the first indoor unit 1, the third indoor unit 3 and the fourth indoor unit 4 perform heating, and the second indoor unit 2 performs humidification. Consequently, the first indoor unit 1, the third indoor unit 3 and the fourth indoor unit 4 are not provided with the humidifying element 27, as is the second indoor unit 2. In addition, the water piping 6 of the type connected to the second indoor unit 2 is not connected to the first indoor unit 1, the third indoor unit 3 and the fourth indoor unit 4.

<Cooling Operation>

During the cooling operation, the first indoor unit 1, the third indoor unit 3, the fourth indoor unit 4 and the second indoor unit 2 cool the room.

If the first indoor unit 1, the third indoor unit 3 and the fourth indoor unit 4 receive a cooling operation command signal from the controller 8, then they perform the cooling operation. During the cooling operation, the first indoor unit 1, the third indoor unit 3 and the fourth indoor unit 4 perform control so that the temperature in the room R approaches the set temperature by switching between thermo-on and thermo-off, the same as during the heating operation described above.

In addition, if the second indoor unit 2 also receives a cooling operation command signal from the controller 8, then it transitions to the temperature adjustment mode and performs the cooling operation, the same as the first indoor unit 1 and the like. In this case, the second indoor control unit 29 closes the water supply and discharge valve 28, and performs control so that the temperature in the room R approaches the set temperature by switching between thermo-on and thermo-off based on the room temperature, the same as the first indoor unit 1 and the like.

As described above, during cooling with this air conditioning system 100, the first indoor unit 1, the second indoor unit 2, the third indoor unit 3 and the fourth indoor unit 4 jointly cool the room R.

<Characteristics>

(1)

In an air conditioning system wherein a plurality of indoor units is installed distributed in the same room R, it is typical in the conventional art to combine a humidification module in each indoor unit and simultaneously process the heating load while humidifying. However, the heating load is often low in offices, and the like, where there is a large amount of heat generated from equipment such as personal computers disposed in the room R. Accordingly, the thermo-off state in an indoor unit may persist. In such a case, the drive of the indoor fan in each indoor unit is kept low, and the blowing out of humidified air is also consequently suppressed. Thereby, there is a risk that the amount of humidification will be insufficient.

However, with this air conditioning system 100, the second indoor unit 2 humidifies the room R independent of the first indoor unit 1, the third indoor unit 3 and the fourth indoor unit 4. In other words, the second indoor unit 2 humidifies the room R by driving the second indoor fan 23 based on the humidity in the room R separate from the control of the first indoor unit 1, the third indoor unit 3 and the fourth indoor unit 4 that repetitively perform thermo-off and thermo-on based on the temperature in the room R. Consequently, with this air conditioning system 100, the second indoor unit 2 ensures the required amount of humidification even if the first indoor unit 1, the third indoor unit 3 and the fourth indoor unit 4 are performing the heating operation. Thereby, the prescribed humidification performance is exhibited regardless of the heating load.

(2)

In an air conditioning system wherein a plurality of indoor units is installed distributed in the same room R, the water piping 6 becomes necessary to supply water for humidification to each of the distributed indoor units. However, because a plurality of indoor units is provided, a water piping becomes necessary in each indoor unit in a conventional air conditioning system, and there is a risk that the water piping construction cost will increase.

However, with this air conditioning system 100, the first indoor unit 1, the second indoor unit 2, the third indoor unit 3 and the fourth indoor unit 4 do not all have a humidifying function; rather, only the second indoor unit 2 has a humidifying function, and the water piping 6 is connected only to the second indoor unit 2. Consequently, compared to the case wherein the water piping 6 is connected to all the indoor units 1-4, the construction of the water piping 6 is simplified. Thereby, the water piping 6 construction cost is kept low.

In addition, because the humidifying element 27 is aggregated in the second indoor unit 2, the equipment cost and the construction expenses are reduced more than the case in which a humidification module is affixed to a plurality of indoor units 1-4.

(3)

With this air conditioning system 100, the second indoor unit 2 can not only humidify, but can also cool. Consequently, the second indoor unit 2 can humidify during the heating season, and cool during the cooling season.

In addition, the required heating capacity is satisfied by the heating capacity of the first indoor unit 1, the third indoor unit 3 and the fourth indoor unit 4, so that the temperature in the room R can be maintained appropriately even when the second indoor unit 2 does not perform the heating operation. In addition, the required cooling load is satisfied by the first indoor unit 1, the second indoor unit, the third indoor unit 3 and the fourth indoor unit 4, and the temperature in the room R can be appropriately maintained by performing the cooling operation not only by the first indoor unit 1, the third indoor unit 3 and the fourth indoor unit 4, but also by the second indoor unit 2.

As discussed above, the heating load is often small in an office, and the like, where there is a large amount of heat generated by equipment such as personal computers. Accordingly, even if the indoor units 1, 2, 3, 4 are selected on the basis of the cooling capacity, the required heating capacity will be sufficiently satisfied even by just the indoor units 1, 3, 4, excluding the second indoor unit 2. Consequently, during the heating operation, the heating capacity will almost never be insufficient even if the second indoor unit 2 performs the humidifying operation in the humidity adjustment mode (humidifying operation mode). Thus, with this air conditioning system 100, the system is constituted without waste and at a low cost.

(4)

In an air conditioning system wherein a plurality of indoor units is installed distributed in the same room R, it is typical in the conventional art to combine a humidification module in each indoor unit, and simultaneously heat and humidify. However, the heating load is often low in offices, and the like, where there is a large amount of heat generated by equipment such as personal computers disposed in the room R. Accordingly, the thermo-off state may persist in an indoor unit. Particularly, if a plurality of indoor units simultaneously heats and humidifies in the same fashion, then the thermo-off state will unfortunately persist in all of the indoor units. In this case, because the drive of the indoor fan in all of the indoor units is kept low, the blowing out of humidified air is also suppressed. Thereby, there is a risk that the amount of humidification will be inadequate.

However, with this air conditioning system 100, the second indoor unit 2 switches between the humidifying operation and the cooling operation in accordance with the operation state of the other indoor units 1, 3, 4. Accordingly, if the other indoor units 1, 3, 4 are heating, then the humidifying capacity of the air conditioning system 100 can be ensured by the second indoor unit 2. Thereby, this air conditioning system 100 can achieve the required humidification performance.

Other Embodiments (1)

In the abovementioned embodiment, although the first indoor unit 1, the third indoor unit 3 and the fourth indoor unit 4 do not have a humidifying function, it is acceptable that they have a humidifying function. In this case as well, the effects of the invention can be achieved the same as described above, excepting the effect of reducing the construction cost of the water piping 6.

(2)

In the abovementioned embodiment, during the humidifying operation, the second indoor unit 2 only humidifies without heating, but it is also acceptable, as needed, to jointly humidify and heat, or to only heat. In this case, during heating and not humidifying, the second indoor fan 23 sends to the room R the air that was heated but not humidified by the second indoor heat exchanger 21.

(3)

In the abovementioned embodiment, the second indoor unit 2 can perform cooling and humidification, but it is also acceptable that it perform heating and dehumidification. In this case, dehumidification is performed without being affected by the thermo-on and thermo-off states of the first indoor unit 1, the third indoor unit 3 and the fourth indoor unit 4 during cooling.

(4)

In the abovementioned embodiment, the plurality of indoor units 1, 2, 3, 4 all jointly air condition the same space, but the present invention is not limited to all of the indoor units 1, 2, 3, 4, which constitute the air conditioning system 1, air conditioning the same space. It is acceptable that a portion of the plurality of indoor units 1, 2, 3, 4 air conditions a different space. For example, it is acceptable that the first indoor unit 1, the second indoor unit 2 and the third indoor unit 3 air condition the same room R, and that the fourth indoor unit 4 air conditions a different room.

(5)

In the abovementioned embodiment, whether the first indoor unit 1, and the like, is performing the heating operation or the cooling operation is detected by the transmission of a signal by the second communication wire 82, but it is acceptable that the signal be transmitted wirelessly instead of by a wire, such as the second communication wire 82.

In addition, in the abovementioned embodiment, the second communication wire 82 connects the controller 8 to the second indoor control unit 29 of the second indoor unit 2, and a signal is transmitted from the controller 8 to the second indoor control unit 29 via the second communication wire 82. However, it is also acceptable that the signal be transmitted to the second indoor control unit 29 by a communication wire that directly connects the first indoor control unit 16 of the first indoor unit 1 to the second indoor control unit 29 of the second indoor unit 2. In this case as well, it is thereby possible to detect whether the first indoor unit 1, and the like, is performing the heating operation or the cooling operation.

Furthermore, the means for detecting whether the first indoor unit 1, and the like, is performing the heating operation or the cooling operation is not limited to a signal transmitted by the second communication wire 82, wirelessly, or the like. For example, it is acceptable to detect whether the first indoor unit 1, and the like, is performing the heating operation or the cooling operation by the room temperature, and the like, detected by the second room temperature thermistor 25.

(6)

In the abovementioned embodiment, the second indoor control unit 29 of the second indoor unit 2 controls the first indoor fan motor 14 and the water supply and discharge valve 28 based on the humidity in the room R during the humidifying operation, but those controlled based on the humidity in the room R are not limited thereto. For example, it is also acceptable for the second motor operated valve 22, a flap (not shown), and the like, to be controlled based on the humidity in the room R.

(7)

In the abovementioned embodiment, the second indoor control unit 29 of the second indoor unit 2 selects the operation mode, but it is also acceptable for the controller 8 to select the operation mode of the second indoor unit 2. In this case, the controller 8 sends via the second communication wire 82 to the second indoor control unit 29 a control signal that indicates the selected operation mode, the specific settings, and the like.

(8)

In the abovementioned embodiment, the second indoor unit 2 automatically switches between the humidity adjustment mode and the temperature adjustment mode in accordance with the operation state of the first indoor unit 1, and the like, but it is also acceptable to perform switching manually. For example, it is acceptable to manually switch the operation mode of the second indoor unit 2 from the controller 8.

In addition, the switching of the operation mode is not limited to the case where all other indoor units 1, 3, 4 are operating, and it is also acceptable to switch the operation mode in accordance with the operation state of a portion of those indoor units. For example, if the first indoor unit 1 and the third indoor unit 3 are performing the heating operation, and the operation of the fourth indoor unit 4 is suspended, then it is also acceptable to perform the humidifying operation and the cooling operation in accordance with the operation state of the first indoor unit 1 and the third indoor unit 3.

(9)

In the abovementioned embodiment, the cooling and heating unit group G1 is constituted by the three indoor control units 1, 3, 4, but the number of indoor units that constitute the cooling and heating unit group G1 is not limited thereto. In addition, in the abovementioned embodiment, the cooling and humidifying unit group G2 is constituted by one indoor unit 2, but the number of indoor units that constitute the cooling and humidifying unit group G2 is not limited thereto.

INDUSTRIAL FIELD OF APPLICATION

By using the air conditioning system according to the present invention, during humidity adjustment, humidity adjustment is performed with priority over temperature adjustment of a space, and humidity adjustment can consequently be performed appropriately with little interference from the temperature adjustment of the space.

What is claimed is:

1. An air conditioning system comprising:

a first indoor unit configured and arranged to air condition a space, said first indoor unit including a first temperature adjusting unit configured and arranged to adjust temperature in said space; and a second indoor unit configured and arranged to air condition said space, said second indoor unit including a second temperature adjusting unit configured and arranged to adjust the temperature in said space and a humidity adjusting unit configured and arranged to adjust humidity in said space, said first indoor unit being configured and arranged to switch between thermo-on/thermo-off control based on said temperature in said space when an operation state of said first indoor unit is a cooling operation state and when said operation state of said first indoor unit is a heating operation state, said second indoor unit being further configured and arranged to humidify said space with said humidity adjusting unit upon determining that said operation state of said first indoor unit is said heating operation state, to cool said space with said second temperature adjusting unit upon determining that said operation state of said first indoor unit is said cooling operation state, to control output of said second indoor unit based on said humidity in said space independently of said thermo-on/thermo-off control of said first indoor unit upon determining that said operation state of said first indoor unit is a heating operation state, and to switch between thermo-on/thermo-off control of said second indoor unit to perform cooling based on the temperature in said space upon determining that said operation state of said first indoor unit is said cooling operation state.

2. The air conditioning system as recited in claim 1, wherein said first indoor unit further comprises:

a first indoor fan configured and arranged to send temperature-adjusted air to said space; and a first control unit configured and arranged to control said first indoor fan based on the temperature in said space; and said second indoor unit comprises:

a second indoor fan configured and arranged to send humidity-adjusted air to said space; and a second control unit configured and arranged to control said second indoor fan based on the humidity in said space during humidity adjustment.

3. The air conditioning system as recited in claim 2, wherein said second indoor unit further comprises a humidity sensor configured and arranged to detect the humidity in said space; and said second control unit is further configured and arranged to control said second indoor fan based on the humidity detected by said humidity sensor.

4. The air conditioning system as recited in claim 2, wherein said second indoor fan is further configured and arranged to send temperature-adjusted air to said space during temperature adjustment and not during humidity adjustment, and send humidity-adjusted air to said space during humidity adjustment.

5. The air conditioning system as recited in claim 1, wherein said first temperature adjusting unit of said first indoor unit is further configured and arranged to perform a heating function;

said humidity adjusting unit of said second indoor unit is further configured and arranged to perform a humidifying function;

said second temperature adjusting unit of said second indoor unit is further configured and arranged to perform a heating function; and during humidification, said second indoor unit is further configured and arranged to humidify said space with greater priority than heating said space.

6. The air conditioning system as recited in claim 5, wherein said first temperature adjusting unit of said first indoor unit is further configured and arranged to perform a cooling function; and said second temperature adjusting unit of said second indoor unit is further configured and arranged to perform a cooling function.

7. The air conditioning system as recited in claim 6, further comprising:

a detecting device configured and arranged to detect whether said first indoor unit is performing one of a heating operation and a cooling operation;

said second indoor unit is further configured and arranged to perform a humidifying operation by said humidity adjusting unit if said first indoor unit is performing the heating operation, and perform a cooling operation by said second temperature adjusting unit if said first indoor unit is performing the cooling operation.

8. The air conditioning system as recited in claim 5, further comprising:

a detecting device configured and arranged to detect whether said first indoor unit is performing a heating operation;

said second indoor unit is further configured and arranged to perform a humidifying operation by said humidity adjusting unit when said first indoor unit is performing the heating operation.

9. The air conditioning system as recited in claim 1, wherein said second indoor unit is further configured and arranged to switch in accordance with the operation state of said first indoor unit between either a temperature adjustment mode that adjusts the temperature in said space by the second temperature adjusting unit, or a humidity adjustment mode that adjusts the humidity in said space by said humidity adjusting unit.

10. The air conditioning system as recited in claim 9, wherein when in said temperature adjustment mode, said second indoor unit is further configured and arranged to control output of said second indoor unit based on the temperature in said space; and when in said humidity adjustment mode, said second indoor unit is further configured and arranged to control output of said second indoor unit based on the humidity in said space.

11. The air conditioning system as recited in claim 10, wherein said second indoor unit comprises:

a second indoor fan configured and arranged to send humidity-adjusted or temperature-adjusted air to said space; and a second control unit configured and arranged to control said second indoor fan based on the temperature in said space in said temperature adjustment mode, and control said second indoor fan based on the humidity in said space in said humidity adjustment mode.

12. The air conditioning system as recited in claim 11, wherein said second indoor unit further comprises a humidity sensor configured and arranged to detect the humidity in said space; and said second control unit is further configured and arranged to control said second indoor fan based on the humidity detected by said humidity sensor in said humidity adjustment mode.

13. The air conditioning system as recited in claim 9, further comprising:

a detecting device configured and arranged to detect the operation state of said first indoor unit.

14. The air conditioning system as recited in claim 13, further comprising:

a selecting device configured and arranged to select between said temperature adjustment mode and said humidity adjustment mode in accordance with the operation state of said first indoor unit detected by said detecting device.

15. The air conditioning system as recited in claim 13, wherein said first temperature adjusting unit of said first indoor unit is further configured and arranged to perform a heating function;

said humidity adjusting unit of said second indoor unit is further configured and arranged to perform a humidifying function;

said detecting device configured and arranged to detect whether said first indoor unit is performing a heating operation; and said second indoor unit is further configured and arranged to humidify said space in said humidity adjustment mode when said first indoor unit is performing the heating operation.

16. The air conditioning system as recited in claim 15, wherein said first temperature adjusting unit of said first indoor unit is further configured and arranged to perform a cooling function;

said second temperature adjusting unit of said second indoor unit is further configured and arranged to perform a cooling function;

said detecting device configured and arranged to detect whether said first indoor unit is performing one of the heating operation and the cooling operation; and said second indoor unit is further configured and arranged to humidify said space in said humidity adjustment mode upon detection that said first indoor unit is performing the heating operation, and cool said space in said temperature adjustment mode upon detection that said first indoor unit is performing the cooling operation.

17. The air conditioning system as recited in claim 1, wherein said first indoor unit is further configured without a humidity adjustment function; and said second indoor unit includes a transport pathway that is arranged to convey water for humidity adjustment from a water source to said second indoor unit.

18. The air conditioning system as recited in claim 1, further comprising m ($m \geqq 2$) units of indoor units that include said first indoor unit and said second indoor unit, and that air condition said space, wherein among said indoor units, at least n ($1 \leqq n \leqq m-1$) units of said indoor units, including said first indoor unit, have a heating function, with a total heating capacity of the n units of said indoor units satisfying a required heating capacity needed for heating load of said space; and at least m−n units of said indoor units, including said second indoor unit, have a humidifying function, and the m−n units of said indoor units perform a humidifying operation in a humidifying operation mode wherein control is performed based on the humidity.

19. The air conditioning system as recited in claim 18, wherein the m units of said indoor units are further configured and arranged to perform a cooling function, and a total cooling capacity of the m units of said indoor units satisfying required cooling capacity needed for a cooling load of said space.

20. The air conditioning system as recited in claim 19, wherein the n units of said indoor units are cooling and heating units that perform the heating operation and the cooling operation; and the m −n units of said indoor units are cooling and humidifying units that perform the cooling operation and the humidifying operation.

21. The air conditioning system as recited in claim 20, wherein said cooling and heating units are configured and arranged to control said heating operation based on the temperature in said space; and when in said humidifying operation mode, said cooling and humidifying units are configured and arranged to control said humidifying operation based on the humidity in said space.

22. The air conditioning system as recited in claim 20, wherein said cooling and heating units are configured and arranged to control the cooling operation based on the temperature in said space; and said cooling and humidifying units are configured and arranged to control the cooling operation based on the temperature in said space.

23. The air conditioning system as recited in claim 20, wherein each of said cooling and heating unit comprises:

a first indoor fan configured and arranged to send air to said space; and a first control unit configured and arranged to control said first indoor fan based on the temperature in said space when in said heating operation; and each of said cooling and humidifying unit comprises:

a second indoor fan configured and arranged to send air to said space; and a second control unit configured and arranged to control said second indoor fan based on the humidity in said space when in said humidifying operation mode.

24. The air conditioning system as recited in claim 23, wherein said first control unit configured and arranged to control said first indoor fan based on the temperature in said space in said cooling operation; and said second control unit configured and arranged to control said second indoor fan based on the temperature in said space in said cooling operation.

25. The air conditioning system as recited in claim 20, further comprising:

a detecting device configured and arranged to detect whether said cooling and heating unit is performing one of said heating operation and said cooling operation;

said cooling and humidifying unit are configured and arranged to perform said humidifying operation in said humidifying operation mode when said cooling and heating unit is performing the heating operation, and perform said cooling operation upon detection that said cooling and heating unit is performing said cooling operation.

26. The air conditioning system as recited in claim 20, wherein said cooling and heating unit and said cooling and humidifying unit each comprises a heat exchanger that constitutes a portion of a refrigeration cycle wherein the refrigerant circulates, and that switches between its role as an evaporator and its role as a condenser as a direction of circulation of said refrigerant changes.

27. The air conditioning system as recited in claim 26, wherein said cooling and humidifying unit further comprises a humidifier unit configured and arranged to humidify the air by releasing moisture into said air that passes therethrough, and perform said humidifying operation by passing through said humidifier unit the air that was heated by said heat exchanger.

28. The air conditioning system as recited in claim 18, wherein the m−n units of said indoor units is configured and arranged to perform said humidifying operation in said humidifying operation mode when at least one unit of the indoor units is performing the heating operation.

29. The air conditioning system as recited in claim 18, wherein the total humidifying capacity of the m−n units of said indoor units satisfies a prescribed required humidifying capacity demanded to humidify said space; and the n units of said indoor units are further configured without a humidifying function.

30. The air conditioning system as recited in, claim 1, further comprising:

a cooling and heating unit group that has a first cooling capacity and a first heating capacity and includes one or a plurality of cooling and heating units that include said first indoor unit and perform a heating operation and a cooling operation;

a cooling and humidifying unit group that has a second cooling capacity and includes one or a plurality of cooling and humidifying units that include said second indoor unit and perform a cooling operation and a humidifying operation;

wherein, a total cooling capacity, which is the sum of said first cooling capacity and said second cooling capacity, satisfies the required cooling capacity needed for a cooling load of said space;

said first heating capacity satisfies the required heating capacity needed for a heating load of said space; and said humidifying operation of said cooling and humidifying unit is performed in a humidifying operation mode wherein control is performed based on the humidity.

31. The air conditioning system as recited in claim 30, wherein a total humidifying capacity of said cooling and humidifying unit satisfies the prescribed required humidifying capacity demanded to humidify said space; and said cooling and heating unit is further configured without a humidifying function.

32. The air conditioning system as recited in claim 1, wherein the second temperature adjusting unit is configured and arranged to heat air for the purpose of humidification upon determining that said operation state of said first indoor unit is said heating operation state.

33. The air conditioning system as recited in claim 1, wherein the humidity adjusting unit is configured and arranged to increase humidity in said space such that humidity in said space approaches a set humidity upon determining that said operation state of said first indoor unit is said heating operation state.

34. The air conditioning system as recited in claim 33, wherein the humidity adjusting unit is configured and arranged to not increase humidity in said space upon determining that said operation state of said first indoor unit is said cooling operation state.

* * * * *